US010513800B2

(12) United States Patent
Sakai

(10) Patent No.: US 10,513,800 B2
(45) Date of Patent: Dec. 24, 2019

(54) METHOD OF MANUFACTURING A DEPOSITED BODY

(71) Applicant: Kabushiki Kaisha Toshiba, Minato-ku (JP)

(72) Inventor: Satomi Sakai, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 220 days.

(21) Appl. No.: 15/696,935

(22) Filed: Sep. 6, 2017

(65) Prior Publication Data

US 2017/0362741 A1 Dec. 21, 2017

Related U.S. Application Data

(63) Continuation of application No. PCT/JP2016/075679, filed on Sep. 1, 2016.

(30) Foreign Application Priority Data

Mar. 18, 2016 (JP) ..... 2016-054826

(51) Int. Cl.

| | |
|---|---|
| ***D04H 3/02*** | (2006.01) |
| ***D04H 3/05*** | (2006.01) |
| ***D01D 5/00*** | (2006.01) |
| ***D01D 7/00*** | (2006.01) |

(52) U.S. Cl.

CPC ..... *D01D 5/0076* (2013.01); *D01D 5/0038* (2013.01); *D01D 5/0069* (2013.01); *D01D 7/00* (2013.01)

(58) Field of Classification Search

CPC .. D01D 5/0007; D01D 5/0015; D01D 5/0023; D01D 5/003; D01D 5/0038; D01D 5/0046; D01D 5/0076; D01D 7/00; D04H 3/02; D04H 3/05

USPC ..... 264/210.2, 210.8, 211.12, 464, 465, 466, 264/484

See application file for complete search history.

(56) References Cited

U.S. PATENT DOCUMENTS

2009/0031691 A1* 2/2009 Tajima ..... D01D 5/0038 57/258

FOREIGN PATENT DOCUMENTS

| | | |
|---|---|---|
| JP | 3-220305 | 9/1991 |
| JP | 2006-169644 | 6/2006 |
| JP | 2015-214161 | 12/2015 |

OTHER PUBLICATIONS

International Search Report dated Nov. 8, 2016 in PCT/JP2016/075679, filed on Sep. 1, 2016 (with English Translation of Categories of cited documents).

Written Opinion dated Nov. 8, 2016 in PCT/JP2016/075679, filed on Sep. 1, 2016.

* cited by examiner

*Primary Examiner* — Leo B Tentoni

(74) *Attorney, Agent, or Firm* — Oblon, McClelland, Maier & Neustadt, L.L.P.

(57) ABSTRACT

According to one embodiment, an electrospinning apparatus is adapted to deposit fibers on a member to form a deposited body. The apparatus includes a processing section. The processing section is capable of forming a mixture section in the deposited body. A first fiber part of the deposited body, and a second fiber part of the deposited body are mixed with each other in the mixture section. The first fiber part is located on the member. The second fiber part is located on the first fiber part.

7 Claims, 12 Drawing Sheets

METHOD OF MANUFACTURING A DEPOSITED BODY

CROSS-REFERENCE TO RELATED APPLICATIONS

This is a continuation application of International Application PCT/JP2016/075679, filed on Sep. 1, 2016. This application also claims priority to Japanese Application No. 2016-054826, filed on Mar. 18, 2016. The entire contents of each are incorporated herein by reference.

FIELD

An embodiment of the invention relates to an electrospinning apparatus and a method of manufacturing deposited body.

BACKGROUND

There exists an electrospinning apparatus for forming a deposited body by depositing a microscopic fiber on a member using an electrospinning method.

The deposited body formed by the electrospinning apparatus is used after exfoliated from the surface of the member in some cases.

Therefore, it is necessary for the deposited body to be exfoliated from the member without a damage.

DETAILED DESCRIPTION

Figure 1:
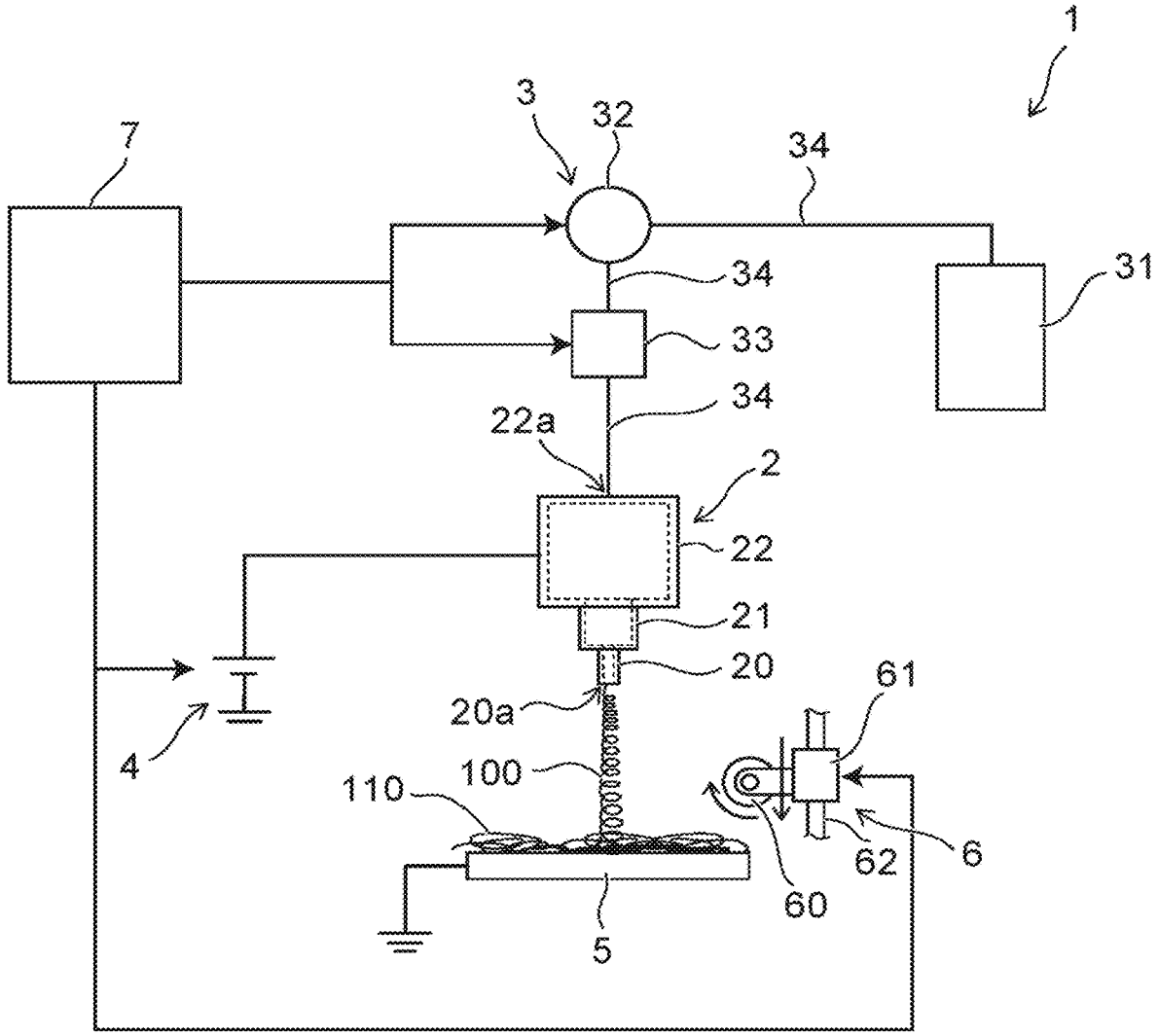
FIG. 1 is a schematic view for illustrating an electrospinning apparatus according to the first embodiment.

According to one embodiment, an electrospinning apparatus is adapted to deposit fibers on a member to form a deposited body. The apparatus includes a processing section. The processing section is capable of forming a mixture section in the deposited body. A first fiber part of the deposited body, and a second fiber part of the deposited body are mixed with each other in the mixture section. The first fiber part is located on the member. The second fiber part is located on the first fiber part.

Embodiments will now be illustrated with reference to the drawings. Similar components in the drawings are marked with the same reference numerals; and a detailed description is omitted as appropriate.

First Embodiment

FIG. 1 is a schematic view for illustrating an electrospinning apparatus 1 according to the first embodiment.

Figure 2:
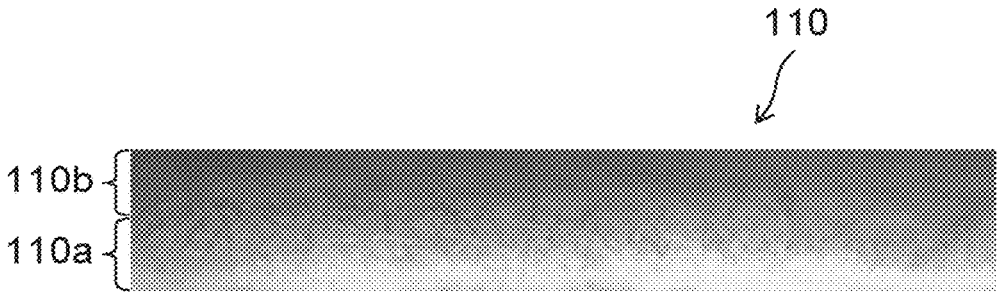
FIG. 2 is a micrograph of a cross-section of a deposited body.

FIG. 2 is a micrograph of a cross-section of a deposited body 110.

As shown in FIG. 1, the electrospinning apparatus 1 is provided with a nozzle head 2, a raw liquid supply section 3, a power supply 4, a collection section 5, a processing section 6, and a control section 7.

It should be noted that in the embodiment, the collection section 5 corresponds to the member on which the fiber 100 is deposited.

The nozzle head 2 has a nozzle 20, a connection section 21, and a main body section 22.

The nozzle 20 exhibits a needle shape. Inside the nozzle 20, there is provided a hole for discharging the raw liquid. The hole for discharging the raw liquid penetrates between an end part on the connection section 21 side of the nozzle 20 and an end part (tip) on the collection section 5 side of the nozzle 20. An opening on the collection section 5 side of the hole for discharging the raw liquid acts as a discharge port 20*a*.

Although there is no limitation on the outer diameter (the diameter in the case in which the nozzle 20 has a cylindrical shape) of the nozzle 20, the smaller the outer diameter is, the more preferable. If the outer diameter is made smaller, the electric field concentration becomes apt to occur in the vicinity of the discharge port 20*a* of the nozzle 20. If the electric field concentration occurs in the vicinity of the discharge port 20*a* of the nozzle 20, it is possible to increase the intensity of the electric field generated between the nozzle 20 and the collection section 5. Therefore, it is possible to lower the voltage applied by the power supply 5. In other words, it is possible to reduce the drive voltage. In this case, the outer diameter of the nozzle 20 can be set in a range of, for example, about 0.3 mm through 1.3 mm.

The dimension (the diameter in the case in which the discharge port 20*a* has a circular shape) of the discharge port 20*a* is not particularly limited. The dimension of the discharge port 20*a* can arbitrarily be changed in accordance with the desired cross-sectional dimension of the fiber 100 to be formed. The dimension (the inner diameter of the nozzle 20) of the discharge port 20*a* can be set in a range of, for example, about 0.1 mm through 1 mm.

The nozzle 20 is formed of a conductive material. It is preferable for the material of the nozzle 20 to have conductivity and a resistance property with respect to the raw liquid described later. The nozzle 20 can be formed from, for example, stainless steel.

The number of the nozzles is not particularly limited, and can arbitrarily be changed in accordance with the size of the collection section 5 and so on. It is sufficient to provide at least one nozzle 20.

In the case of providing a plurality of nozzles 20, the nozzles 20 are provided side by side with predetermined intervals. It should be noted that the arrangement of the nozzles 20 is not particularly limited. For example, in the embodiment, the nozzles 20 can be provided in a line, or provided in a circle, or in a concentric manner, or provided in a zigzag manner or in a matrix.

The connection section 21 is provided between the nozzle 20 and the main body section 22. The connection section 21 is not necessarily required, and it is also possible to arrange that the nozzle 20 is directly provided to the main body section 22. Inside the connection section 21, there is provided a hole for supplying the raw liquid from the main body section 22 to the nozzle 20. The hole provided inside the connection section 21 is communicated with the hole provided inside the nozzle 20, and a space provided inside the main body section 22.

The connection section 21 is formed of a conductive material. It is preferable for the material of the connection section 21 to have conductivity and a resistance property with respect to the raw liquid. The connection section 21 can be formed from, for example, stainless steel.

The main body section 22 exhibits a plate shape. Inside the main body section 22, there is provided the space in which the raw liquid is contained.

Further, the main body section 22 is provided with a supply port 22*a*. The raw liquid supplied from the raw liquid supply section 3 is introduced into the main body section 22 via the supply port 22*a*. The number and the arrangement of the supply ports 22*a* are not particularly limited. The supply port 22*a* can be provided, for example, on the opposite side to the side, on which the nozzle 20 is provided, of the main body section 22.

It is preferable for the material of the main body section 22 to have conductivity and a resistance property with respect to the raw liquid. The main body section 22 can be formed from, for example, stainless steel.

It should be noted that although the nozzle head 2 illustrated in FIG. 1 is a so-called needle-type nozzle head, the type of the nozzle head is not limited thereto. The nozzle head can also be, for example, a so-called blade-type nozzle head.

The raw liquid supply section 3 includes a housing section 31, a supply section 32, a raw liquid control section 33, and piping 34.

The housing section 31 houses the raw liquid. The housing section 31 is formed of a material having a resistance property with respect to the raw liquid. The housing section 31 can be formed from, for example, stainless steel.

The raw liquid obtained by dissolving a polymer substance in a solvent.

The polymer substance is not particularly limited, but can arbitrarily be changed in accordance with the material of the fiber 100 to be formed.

It is sufficient for the solvent to be able to dissolve the polymer substance. The solvent can arbitrarily be changed in accordance with the polymer substance to be dissolved.

As described later, the raw liquid is arranged to remain in the vicinity of the discharge port 20*a* due to the surface tension. Therefore, the viscosity of the raw liquid can arbitrarily be changed in accordance with the dimension of the discharge port 20*a*. The viscosity of the raw liquid can be obtained by performing an experiment or a simulation. Further, the viscosity of the raw liquid can be controlled by the mixture ratio between the solvent and the polymer substance.

The supply section 32 supplies the main body section 22 with the raw liquid contained in the housing section 31. As the supply section 32, there can be used, for example, a pump having a resistance property with respect to the raw liquid. Further, the supply section 32 can also be defined as, for example, a section for supplying the housing section 31 with a gas to pressure feed the raw liquid contained in the housing section 31.

The raw liquid control section 33 controls the flow rate, the pressure, and so on of the raw liquid supplied to the main body section 22 to prevent the raw liquid located inside the main body section 22 from being pushed out from the discharge port 20*a* when the new raw liquid is supplied inside the main body section 22. It should be noted that the control amount to the raw liquid control section 33 can arbitrarily be changed in accordance with the dimension of the discharge port 20*a*, the viscosity of the raw liquid, and so on. The control amount to the raw liquid control section 33 can be obtained by performing an experiment or a simulation.

Further, the raw liquid control section 33 can also be arranged to switch between start and stop of the supply of the raw liquid.

It should be noted that the supply section 32 and the raw liquid control section 33 are not necessarily required. For example, if it is arranged that the housing section 31 is provided at a position higher than the position of the main body section 22, the raw liquid can be supplied to the main body section 22 using the gravitational force. Further, by arbitrarily setting the height position of the housing section 31, it is possible to prevent the raw liquid located inside the main body section 22 from being pushed out from the discharge port 20*a* when the new raw liquid is supplied inside the main body section 22. On this occasion, the height position of the housing section 31 can arbitrarily be changed in accordance with the dimension of the discharge port 20*a*, the viscosity of the raw liquid, and so on. The height position of the housing section 31 can be obtained by performing an experiment or a simulation.

The piping 34 is provided between the housing section 31 and supply section 32, between the supply section 32 and the raw liquid control section 33, and between the raw liquid control section 33 and the main body section 22. The piping 34 forms a flow channel of the raw liquid. The piping 34 is formed of a material having a resistance property with respect to the raw liquid.

The power supply 4 applies a voltage to the nozzle 20 via the main body section 22 and the connection section 21. It should be noted that it is also possible to arrange that a terminal not shown electrically connected to the nozzle 20 is provided. In this case, the power supply 4 applies the voltage to the nozzle 20 via the terminal not shown. Therefore, it is sufficient to arrange that the voltage can be applied by the power supply 4 to the nozzle 20.

The polarity of the voltage to be applied to the nozzle 20 can be set to plus, or can also be set to minus. It should be noted that the power supply 4 illustrated in FIG. 1 applies a positive voltage to the nozzle 20.

The voltage applied to the nozzle 20 can arbitrarily be changed in accordance with the type of the polymer substance included in the raw liquid, the distance between the nozzle 20 and the collection section 5, and so on. For example, the power supply 4 can be arranged to apply the voltage to the nozzle 20 so that the potential difference between the nozzle 20 and the collection section 5 becomes not lower than 10 kV.

As the power supply 4, there can be used, for example, a direct-current high-voltage power supply. The power supply 4 can be arranged to output, for example, a direct-current voltage not lower than 10 kV and not higher than 100 kV.

The collection section 5 is provided on the side, on which the raw liquid is discharged, of the nozzle 20. The collection section 5 is grounded. It is also possible to arrange that the voltage having an opposite polarity to the voltage applied to the nozzle 20 is applied to the collection section 5. The collection section 5 can be formed of a conductive material. It is preferable for the material of the collection section 5 to have conductivity and a resistance property with respect to the raw liquid. As the material of the collection section 5, there can be used, for example, stainless steel.

The collection section 5 can be arranged to exhibit, for example, a plate shape or a sheet shape. In the case of the collection section 5 exhibiting the sheet shape, it is also possible to arrange that the fiber 100 is deposited on the collection section 5 wound around a roll or the like.

The deposited body 110 formed on the collection section 5 is exfoliated from the collection section 5. The deposited body 110 is used as, for example, a nonwoven cloth or a filter. It should be noted that the application of the deposited body 110 is not limited to those illustrated above.

Here, when the fiber 100 charged is deposited on the collection section 5, the potential of the surface of the deposited body 110 rises as the thickness of the deposited body 110 increases. Therefore, as the thickness of the deposited body 110 increases, the fibers 100 become to repel each other on the surface of the deposited body 110. As a result, as shown in FIG. 2, a region 110*a* high in density of the fiber 100 occurs on the collection section 5 side, and a region 110*b* low in density of the fiber 100 occurs on the opposite side (the surface side of the deposited body 110) to the collection section 5 side in the thickness direction of the deposited body 110.

Figure 3:
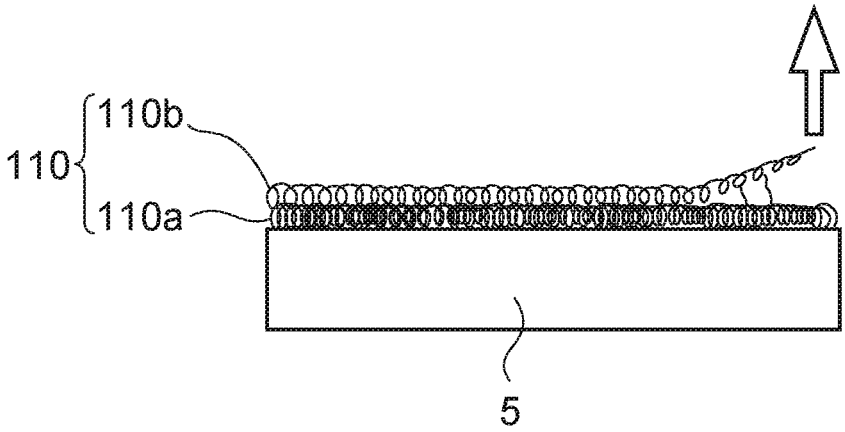
FIG. 3 (PRIOR ART)
FIG. 3 is a schematic view for illustrating exfoliation of the deposited body according to a comparative example.

FIG. 3 is a schematic view for illustrating exfoliation of the deposited body 110 according to a comparative example.

When exfoliating the deposited body 110 from the collection section 5, the obverse side of the deposited body 110 is pulled upward.

However, the bonding force between the region 110*a* high in density of the fiber 100 and the region 110*b* low in density of the fiber 100 is weaker than the bonding force between the region 110*a* high in density of the fiber 100 and the collection section 5.

Therefore, as shown in FIG. 3, there is a possibility that the exfoliation does not occur between the region 110*a* high in density of the fiber 100 and the collection section 5, but occurs between the region 110*b* low in density of the fiber 100 and the region 110*a* high in density of the fiber 100. In other words, there is a possibility that the deposited body 100 is damaged when exfoliating the deposited body 100 from the collection section 5.

As described above, when forming the deposited body using the electrospinning method, in the thickness direction of the deposited body, the region high in density of the fiber occurs in a part closer to the member, and on the region high in density of the fiber, there occurs the region lower in density of the fiber than the region high in density of the fiber. In this case, when exfoliating the deposited body from the member, the exfoliation does not occur between the region high in density of the fiber and the member, but the exfoliation is apt to occur between the region low in density of the fiber and the region high in density of the fiber.

Therefore, the electrospinning apparatus 1 according to the embodiment is provided with the processing section 6.

The processing section 6 processes the deposited body 110 to form a mixture section 110*c*, in which the fiber 100 located in the region 110*a* high in density of the fiber 100 and the fiber 100 located in the region 110*b* low in density of the fiber 100 are mixed with each other, in the deposited body 110.

In other words, the processing section 6 forms the mixture section 110*c*, in which the fiber 100 located on the collection section 5 side of the deposited body 100 and the fiber 100 located on the opposite side to the collection section 5 side of the deposited body 110 are mixed with each other, in the deposited body 110.

As shown in FIG. 1, the processing section 6 has a contact section 60, a moving section 61, and a guide section 62.

The contact section 60 has contact with the deposited body 110. The contact section 60 scrapes the deposited body 110 upward to thereby form the mixture section 110*c* in the deposited body 110.

As the contact section 60, there can be used a rotating body such as a roller or a brush. In this case, the larger the friction coefficient of the surface of the contact section 60 is, the more preferable. Further, it is preferable to make the contact section 60 have elasticity. As the contact section 60, there can be used, for example, a roller obtained by lining a metal shaft with resin such as rubber. The type of the resin is not particularly limited, but it is possible to use, for example, polyurethane rubber as the resin.

The moving section 61 rotatably holds the contact section 60, and at the same time, moves the contact section 60 to an end part of the deposited body 110. Then, the contact section 60 is pressed against to have contact with the end part of the deposited body 110, and the contact section 60 is rotated in a predetermined direction in that state. Specifically, the moving section 61 presses the contact section 60 against the end part of the deposited body 110 to make the contact section 60 have contact with the end part of the deposited body 110, and rotates the contact section 60 in the direction of scraping the both fibers 100 upward so as to be mixed with each other from the region 110*a* high in density of the fiber 100 to the region 110*b* low in density of the fiber 100 in the deposited body 110.

The moving section 61 is configured so as to move the contact section 60 in the direction of making the contact section 60 come closer to the deposited body 110, and in the direction of getting away from the deposited body 110.

Further, the moving section 61 controls the force (pressing force) when pressing the contact section 60 against the deposited body 110.

The moving section 61 can be made to be provided with, for example, a control motor such as a servomotor, or an air cylinder.

The guide section 62 defines the moving direction of the moving section 61. As the guide section 62, there can be used, for example, a linear motion bearing.

The control section 7 controls the operations of the supply section 32, the raw liquid control section 33, the power supply 4, and the moving section 61.

As the control section 7, there is used a computer provided with, for example, a CPU (Central Processing Unit) and a memory.

Then, an operation of the electrospinning apparatus 1 will be described.

The raw liquid is retained in the vicinity of the discharge port 20*a* of the nozzle 20 due to the surface tension.

The power supply 4 applies the voltage to the nozzle 20. Then, the raw liquid located in the vicinity of the discharge port 20*a* is charged to have a predetermined polarity. In the case of the apparatus illustrated in FIG. 1, the raw liquid located in the vicinity of the discharge port 20*a* is positively charged.

Since the collection section 5 is grounded, an electric field is generated between the nozzle 20 and the collection section 5. Then, when the electrostatic force acting along the line of electric force becomes stronger than the surface tension, the raw liquid located in the vicinity of the discharge port 20*a* is drawn toward the collection section 5 due to the electrostatic force. The raw liquid thus drawn is stretched, and the solvent included in the raw liquid evaporates to thereby form the fiber 100. The fiber 100 thus formed is deposited on the collection section 5 to thereby form the deposited body 110.

Then, the mixture section 110*c* is formed in the deposited body 110.

Figure 4:
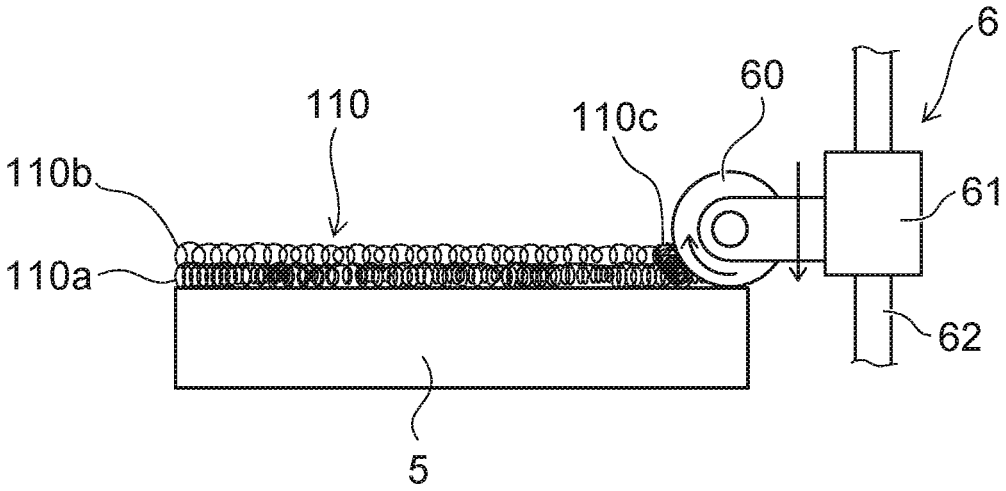
FIG. 4 is a schematic view for illustrating the formation of the mixture section.

FIG. 4 is a schematic view for illustrating the formation of the mixture section 110*c*.

As shown in FIG. 4, the moving section 61 rotates the contact section 60, and at the same time presses the contact section 60 against the deposited body 110. Then, the deposited body 110 is scraped upward to thereby mix the fiber 100 located in the region 110*a* high in density of the fiber 100 and the fiber 100 located in the region 110*b* low in density of the fiber 100 with each other to form the mixture section 110*c*.

In the mixture section 110*c*, since the fiber 100 located in the region 110*a* high in density of the fiber 100 and the fiber 100 located in the region 110*b* low in density of the fiber 100 are entwined with each other, the region 110*a* high in density of the fiber 100 and the region 110*b* low in density of the fiber 100 are tightly bonded to each other. Further, the mixture section 110*c* includes the fiber 100 having contact with the collection section 5.

Therefore, if the mixture section 110*c* is pulled upward, the deposited body 110 can be exfoliated from the collection section 5 without causing the exfoliation between the region 110*b* low in density of the fiber 100 and the region 110*a* high in density of the fiber 100.

Therefore, according to the electrospinning apparatus 1 related to the embodiment, the damage of the deposited body 110 can be prevented.

Figure 5:
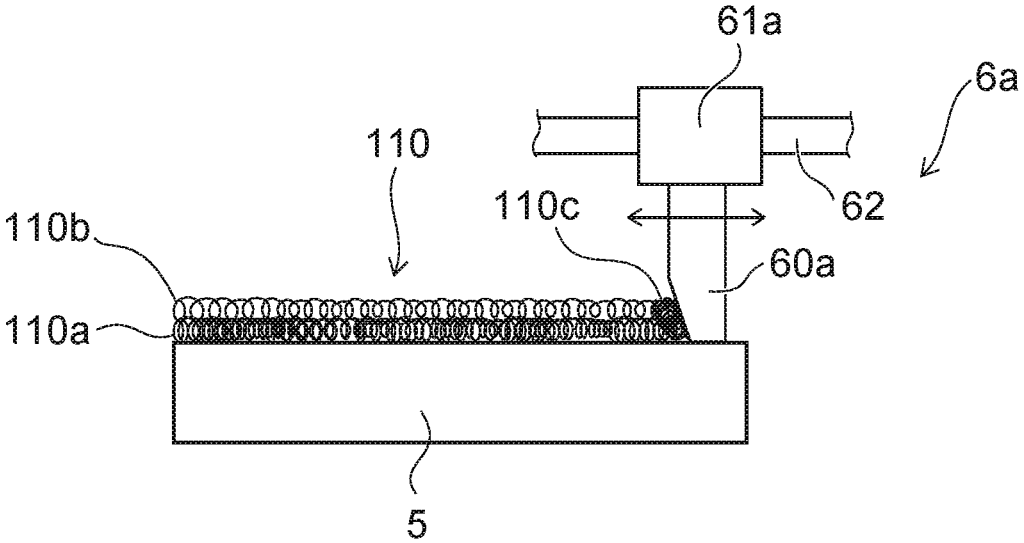
FIG. 5 is a schematic view for illustrating a processing section 6*a* according to another embodiment.

FIG. 5 is a schematic view for illustrating a processing section 6*a* according to another embodiment.

As shown in FIG. 5, the processing section 6*a* has a contact section 60*a*, a moving section 61*a*, and the guide section 62.

The contact section 60*a* has contact with the deposited body 110. The contact section 60*a* scrapes aside the deposited body 110 to thereby form the mixture section 110*c* in the deposited body 110.

As the contact section 60*a*, there can be used, for example, a plate-like body. In this case, it is preferable for the hardness of the contact section 60*a* to be made lower than the hardness of the collection section 5. If the hardness of the contact section 60*a* is lower than the hardness of the collection section 5, it is possible to prevent the damage from occurring in the collection section 5 even if the contact section 60*a* and the collection section 5 are made to have contact with each other. The contact section 60*a* can be formed from, for example, resin.

The moving section 61*a* holds the contact section 60*a*, and at the same time, makes the tip of the contact section 60*a* have contact with the surface of the collection section 5 on which the fiber 100 is deposited. Further, the moving section 61*a* reciprocates the contact section 60*a* in a direction parallel to the surface of the collection section 5 on which the fiber 100 is deposited.

The moving section 61*a* can be made to be provided with, for example, a control motor such as a servomotor or, an air cylinder.

Although the processing section 6 described above scrapes the deposited body 110 upward to thereby form the mixture section 110*c*, the processing section 6*a* according to the embodiment forms the mixture section 110*c* by scraping aside the deposited body 110. Therefore, if the mixture section 110*c* is pulled upward, the deposited body 110 can be exfoliated from the collection section 5 without causing the exfoliation between the region 110*b* low in density of the fiber 100 and the region 110*a* high in density of the fiber 100.

Therefore, according to the electrospinning apparatus 1 related to the embodiment, the damage of the deposited body 110 can be prevented.

As described above, the configuration of the processing section is not particularly limited providing the mixture section 110*c*, in which the fiber 100 located in the region 110*a* high in density of the fiber 100 and the fiber 100 located in the region 110*b* low in density of the fiber 100 are mixed with each other, can be formed in the deposited body 110.

However, if the roller is used as the contact section 60, it is possible to prevent the damage from occurring in the collection section 5 or a base member 120 described later.

Further, although there is illustrated the case of forming the mixture section 110*c* in the vicinity of the end part of the deposited body 110, the formation position of the mixture section 110*c* is not particularly limited. For example, it is also possible to segmentalize the deposited body 110, and at the same time, form the mixture section 110*c*. It should be noted that since the mixture section 110*c* is removed in a later process, if the mixture section 110*c* is formed in the vicinity of the end part of the deposited body 110, the region of the part to be the product can be made large.

Second Embodiment

Figure 6:
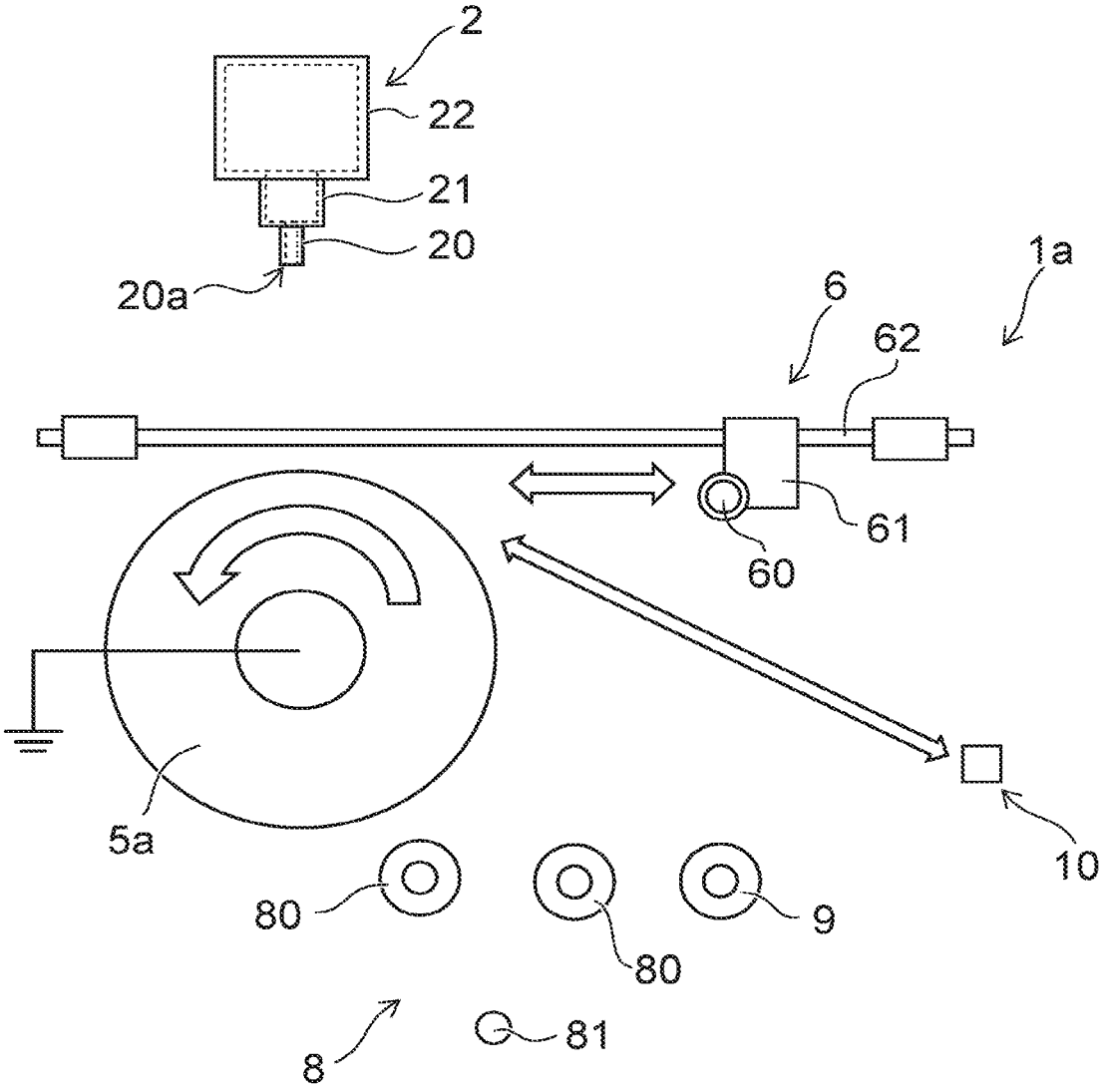
FIG. 6 is a schematic view for illustrating an electrospinning apparatus according to a second embodiment.

FIG. 6 is a schematic view for illustrating an electrospinning apparatus 1*a* according to a second embodiment.

It should be noted that in FIG. 6, the raw liquid supply section 3, the power supply 4 and the control section 7 are omitted from the drawing.

As shown in FIG. 6, a collection section 5*a* is provided on the side, on which the raw liquid is discharged, of the nozzle 20.

It should be noted that in the embodiment, the collection section 5*a* corresponds to the member on which the fiber 100 is deposited.

The collection section 5*a* is grounded. It is also possible to arrange that the voltage having an opposite polarity to the voltage applied to the nozzle 20 is applied to the collection section 5*a*. The collection section 5*a* can be formed of a conductive material. It is preferable for the material of the collection section 5*a* to have conductivity and a resistance property with respect to the raw liquid. As the material of the collection section 5*a*, there can be used, for example, stainless steel.

The collection section 5*a* is a rotatable roller. The collection section 5*a* is arranged to rotate due to a drive section not shown.

A tension section 8 is provided between the collection section 5*a* and a wind-up roller 9.

The tension section 8 has a pair of support rollers 80 and a dancer roller 81.

The pair of support rollers 80 support the deposited body shaped like a strip on a roller 5*a* described later.

The dancer roller 81 is provided between the support roller 80 and the support roller 80, and applies tension to the deposited body shaped like a strip described later. By applying the tension to the deposited body shaped like a strip described later using the dancer roller 81, the deposited body is exfoliated from the collection section 5*a*. Further, the deposited body shaped like a strip described later is prevented from being loosened between the collection section 5*a* and the wind-up roller 9.

The dancer roller 81 can be one for applying the tension to the deposited body described later with the weight, or can also be one for applying the tension to the deposited body with a spring or the like.

The wind-up roller 9 is arranged to rotate due to a drive apparatus not shown.

An exfoliation section 10 holds the mixture section 110*c*, and moves in a predetermined direction to separate the mixture section 110*c* from the collection section 5*a*. Specifically, the exfoliation section 10 exfoliates the deposited body 110 with a predetermined length from the collection section 5*a*.

The exfoliation section 10 can be made to be provided with an adhesive tape or a mechanical chuck. Further, it is also possible to make the exfoliation section 10 be provided with a moving section for moving the adhesive tape or the mechanical chuck, a guide section for defining the moving direction of the moving section, and so on similarly to the processing section 6.

Then, an operation of the electrospinning apparatus 1*a* will be described.

FIG. 7A through FIG. 9 are schematic views for illustrating the operation of the electrospinning apparatus 1*a*.

Figure 7A:
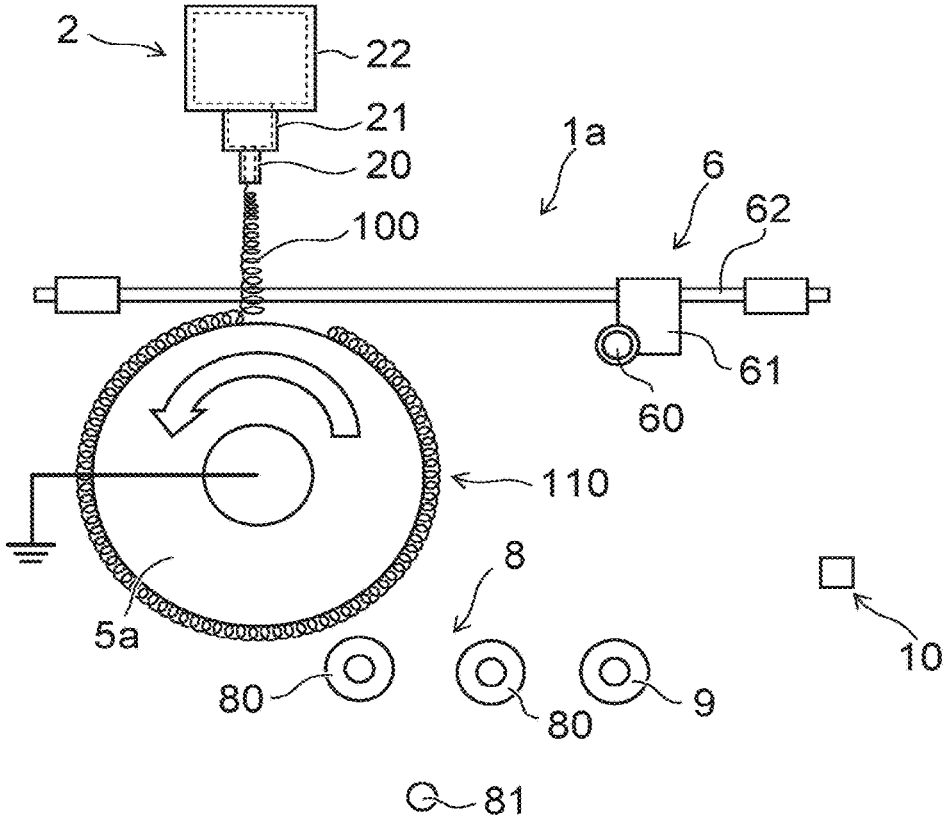
FIG. 7A to FIG. 9 are schematic views for illustrating the operation of the electrospinning apparatus.

Firstly, as shown in FIG. 7A, the raw liquid is drawn from the nozzle 20 to form the fiber 100, and then the fiber 100 thus formed is deposited on the collection section 5*a* to form the deposited body 110. On this occasion, by rotating the collection section 5*a*, the deposited body 110 shaped like a strip is formed.

Figure 7B:
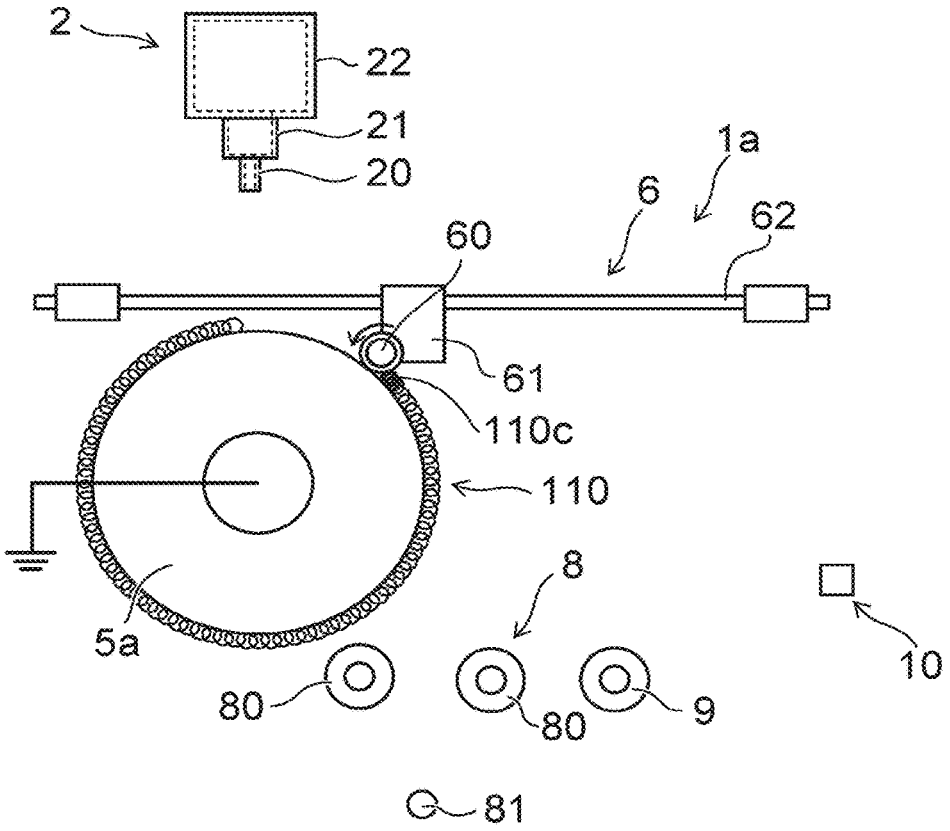

Then, as shown in FIG. 7B, the moving section 61 rotates the contact section 60, and at the same time presses the contact section 60 against the deposited body 110. Then, the deposited body 110 is scraped upward to form the mixture section 110*c*.

Figure 8A:
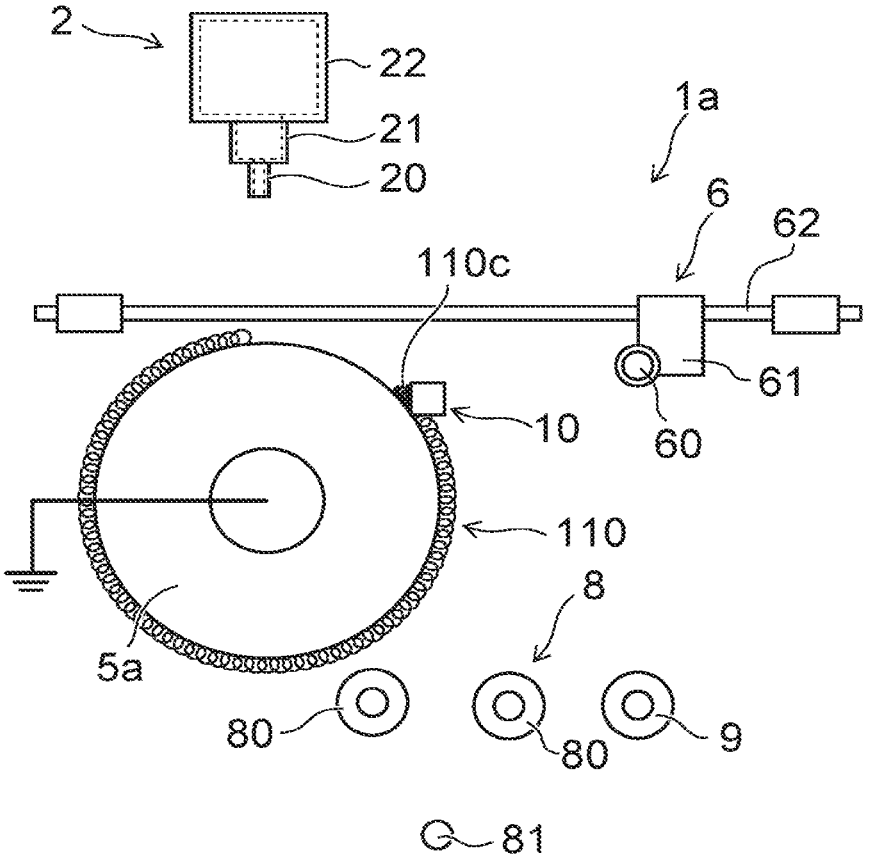

Then, as shown in FIG. 8A, the exfoliation section 10 is moved to the position of the mixture section 110*c*, to make the exfoliation section 10 hold the mixture section 110*c*.

Figure 8B:
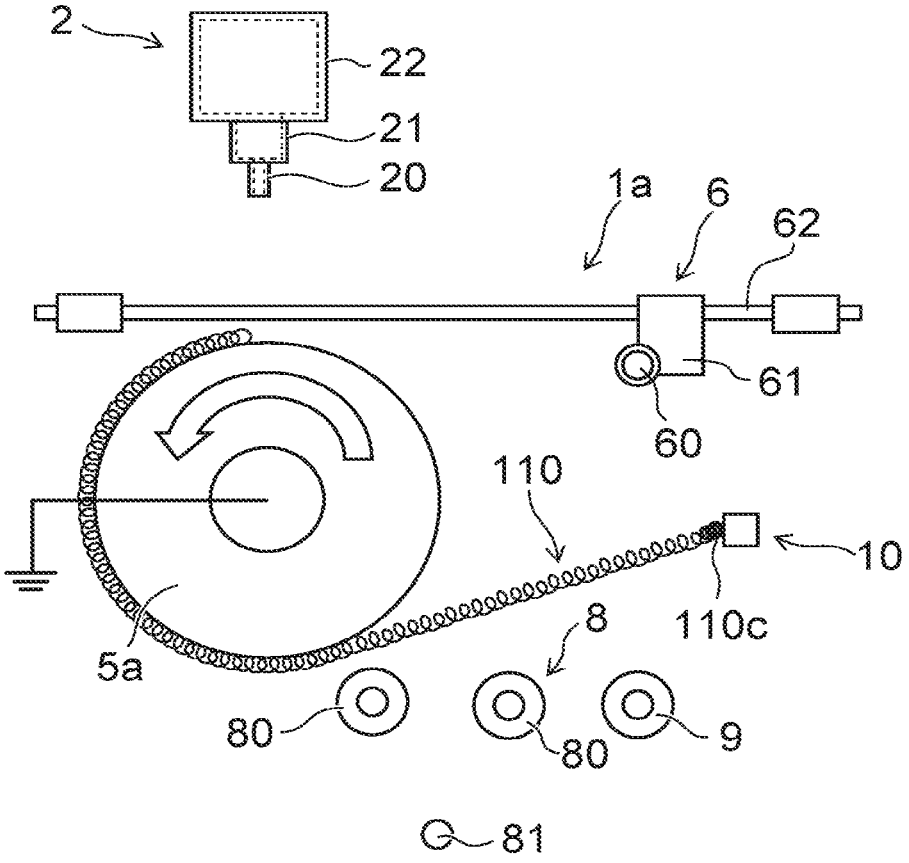

Then, as shown in FIG. 8B, the exfoliation section 10 is moved in a direction of getting away from the collection section 5*a*. Then, the deposited body 110 with a predetermined length is exfoliated from the collection section 5*a*.

Figure 9:
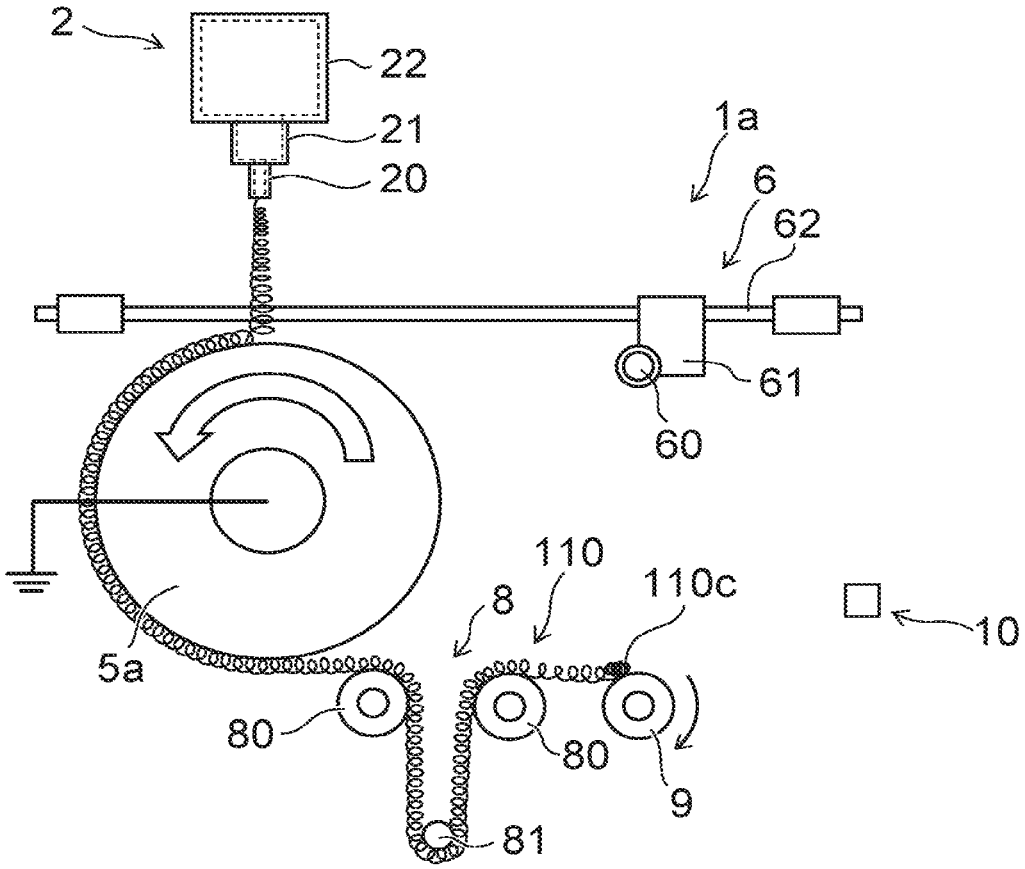

Then, as shown in FIG. 9, an operator fixes the mixture section 110*c* to the wind-up roller 9 via the tension section 8.

Subsequently, in substantially the same manner as in the electrospinning apparatus 1, the deposited body 110 is formed on the collection section 5*a*. Further, by rotating the collection section 5*a* and the wind-up roller 9, the deposited body 110 shaped like a strip is formed continuously. On this occasion, by applying the tension to the deposited body 110 shaped like a strip using the dancer roller 81, the deposited body 110 is exfoliated from the collection section 5*a*. Further, the deposited body 110 shaped like a strip is prevented from being loosened between the collection section 5*a* and the wind-up roller 9.

Third Embodiment

Figure 10:
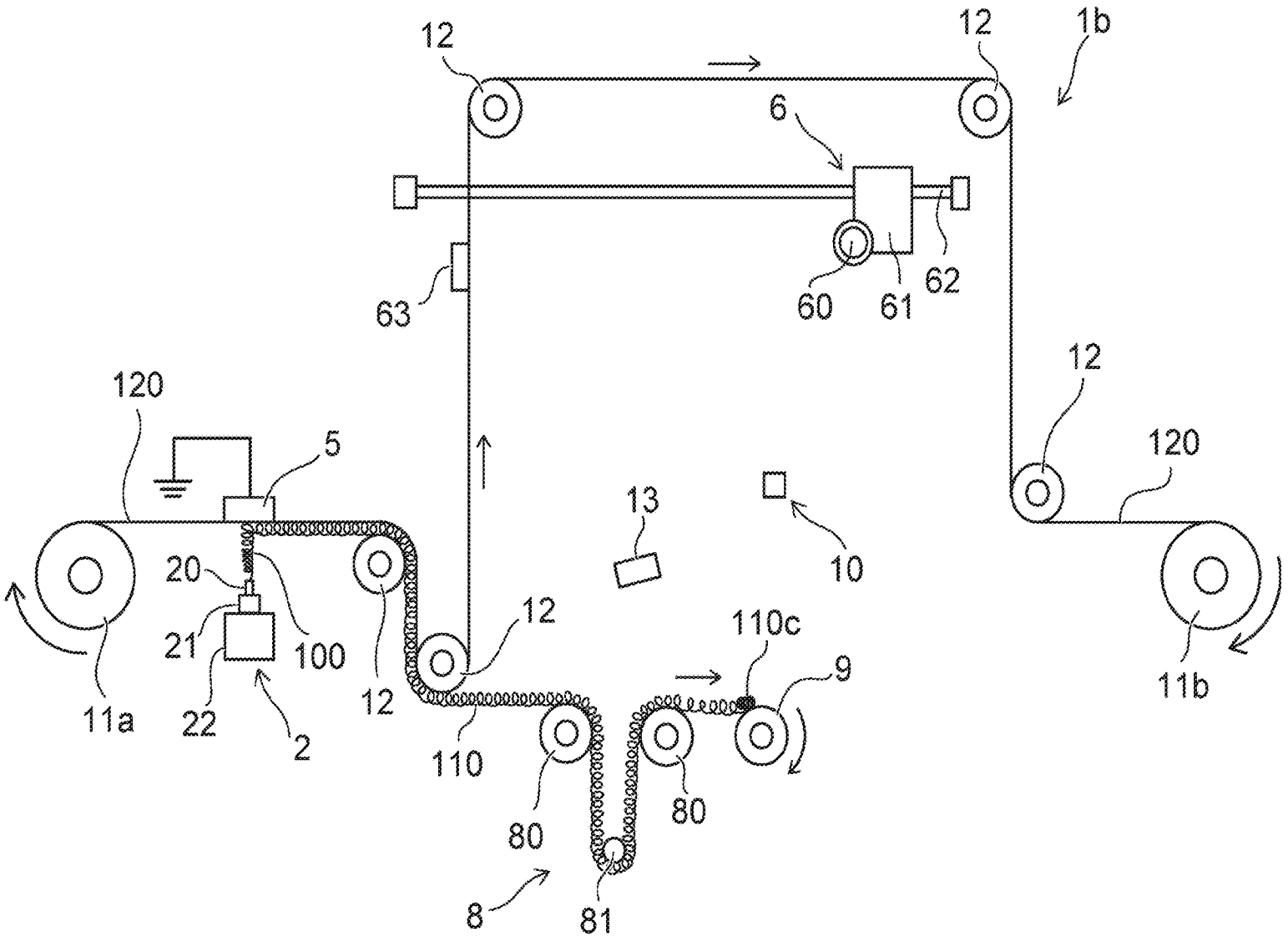
FIG. 10 is a schematic view for illustrating an electrospinning apparatus according to a third embodiment.

FIG. 10 is a schematic view for illustrating an electrospinning apparatus 1*b* according to a third embodiment.

It should be noted that in FIG. 10, the raw liquid supply section 3, the power supply 4 and the control section 7 are omitted from the drawing.

Further, in the embodiment, the base member 120 corresponds to the member on which the fiber 100 is deposited.

As shown in FIG. 10, around a roller 11*a*, there is wound the base member 120 on which the deposited body 110 has not yet been formed. The base member 120 exhibits a strip shape. The material of the base member 120 is not particularly limited, and the base member 120 can be formed of, for example, paper or aluminum.

The wind-up roller 11*b* takes up the base member 120 from which the deposited body 110 has been exfoliated.

The roller 11*a* and the wind-up roller 11*b* regionrranged to be rotated by the drive apparatus not shown.

Support rollers 12 are provided on a conveying path of the base member 120 between the roller 11*a* and the wind-up roller 11*b*. The number and the arrangement of the support rollers 12 can arbitrarily be changed in accordance with the conveying path of the base member 120.

A charge neutralizer 13 can be provided in the vicinity of the position where the deposited body 110 is exfoliated from the base member 120. The deposited body 110 is electrically charged. Therefore, there is a possibility that it becomes difficult to exfoliate the deposited body 110 from the base member 120, or the deposited body 110 once exfoliated is adsorbed to the dancer roller 81 or the support rollers 80. Therefore, it is arranged that the charge neutralizer 13 is provided to thereby reduce the charge amount of the deposited body 110.

A receiving platform 63 is provided at a position opposed to the contact section 60. It is arranged that the base member 120 passes through the contact section 60 side of the receiving platform 63.

Then, an operation of the electrospinning apparatus 1*b* will be described.

FIG. 11 through FIG. 15 are schematic views for illustrating the operation of the electrospinning apparatus 1*b*.

Figure 11:
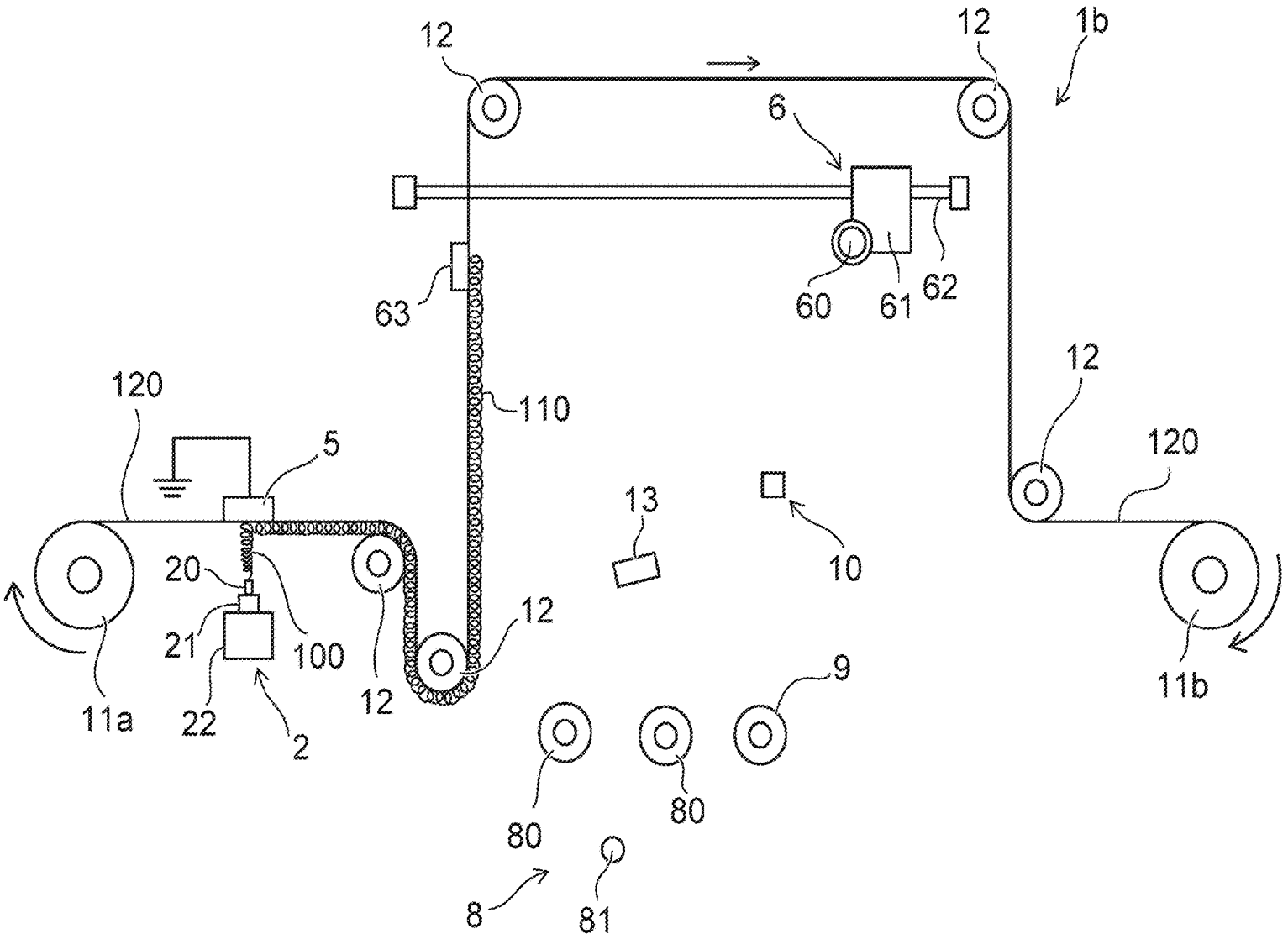
FIG. 11 to FIG. 15 are schematic views for illustrating the operation of the electrospinning apparatus.

Firstly, as shown in FIG. 11, the raw liquid is drawn from the nozzle 20 to form the fiber 100, and then the fiber 100 thus formed is deposited on the base member 120 to form the deposited body 110. On this occasion, by rotating the roller 11*a* and the wind-up roller 11*b*, the deposited body 110 shaped like a strip is formed.

Figure 12:
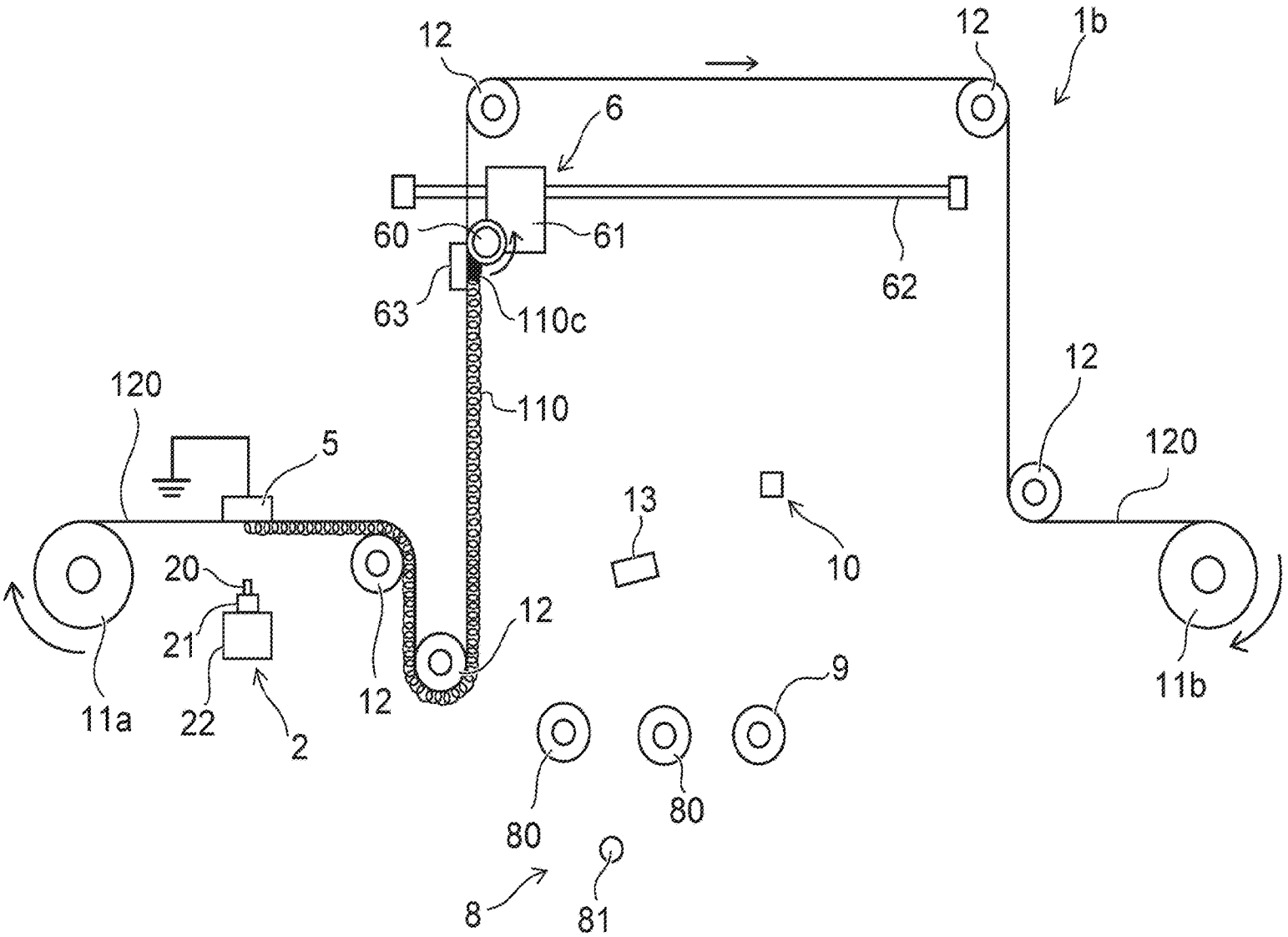

Then, as shown in FIG. 12, the moving section 61 rotates the contact section 60, and at the same time presses the contact section 60 against the deposited body 110. Then, the deposited body 110 sandwiched between the receiving platform 63 and the contact section 60 is scraped upward to form the mixture section 110*c*.

Figure 13:
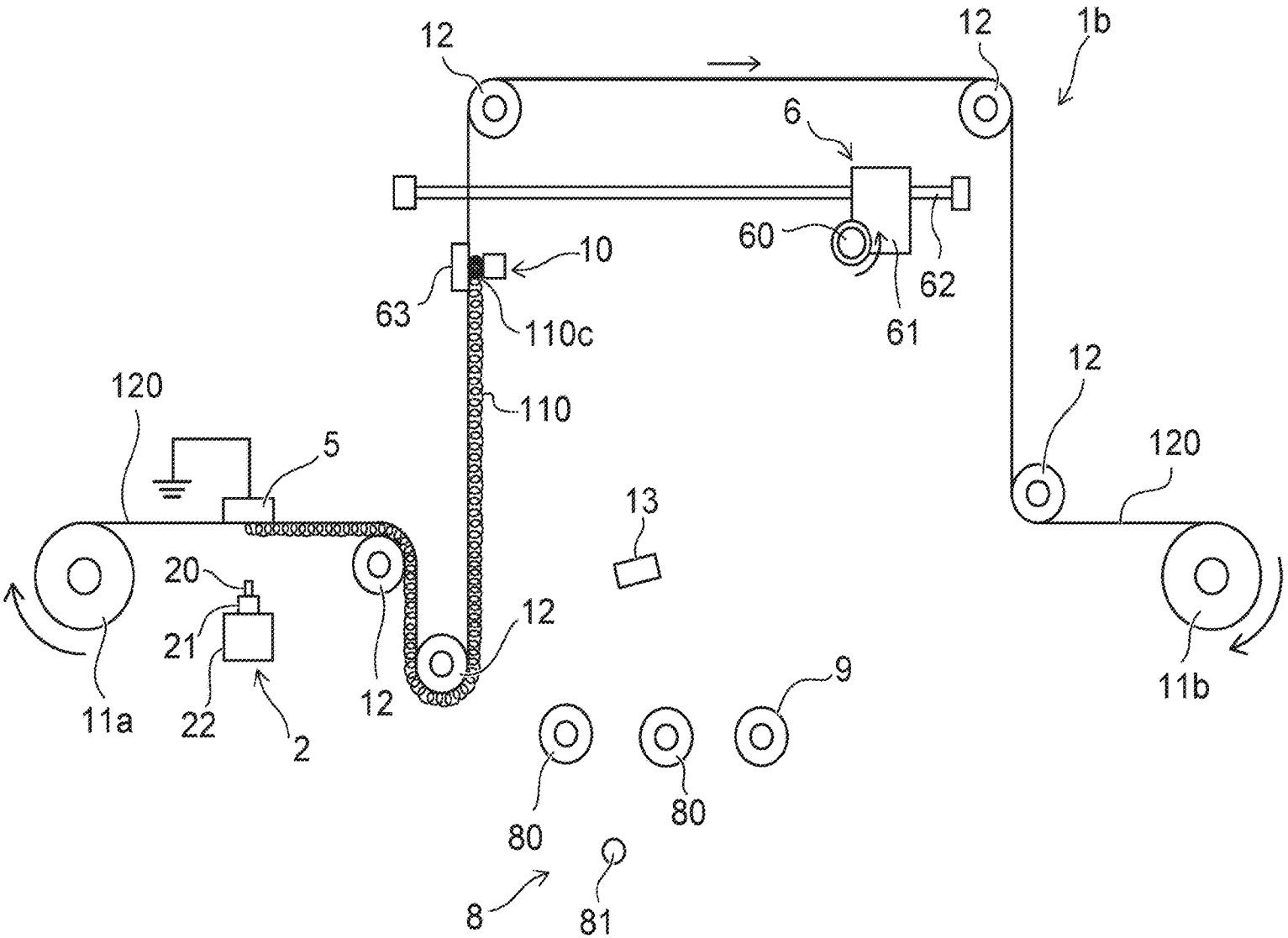

Then, as shown in FIG. 13, the exfoliation section 10 is moved to the position of the mixture section 110*c*, to make the exfoliation section 10 hold the mixture section 110*c*.

Figure 14:
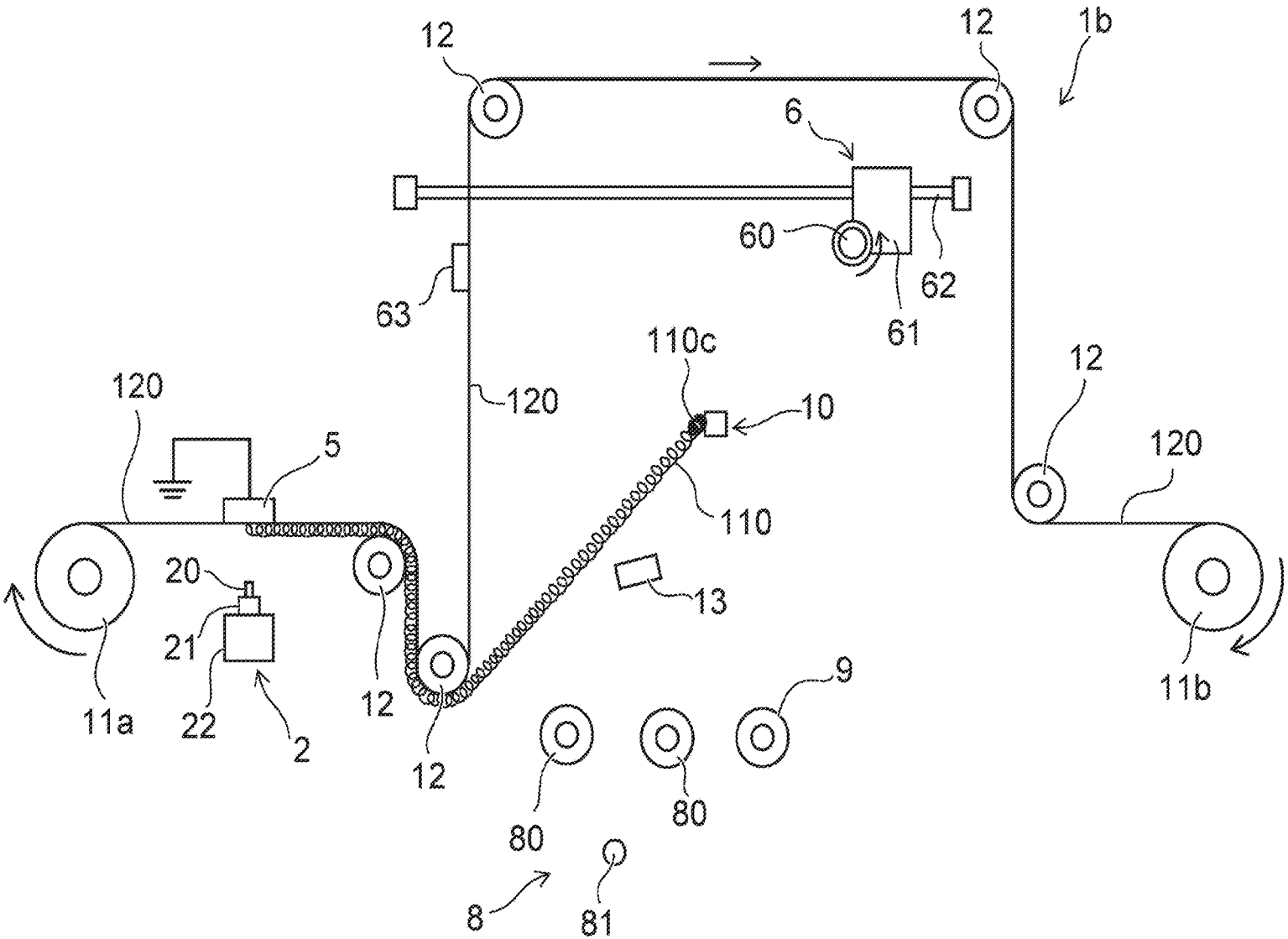

Then, as shown in FIG. 14, the exfoliation section 10 is moved in a predetermined direction, namely the direction of getting away from the receiving platform 63. Then, the deposited body 110 with a predetermined length is exfoliated from the base member 120.

Figure 15:
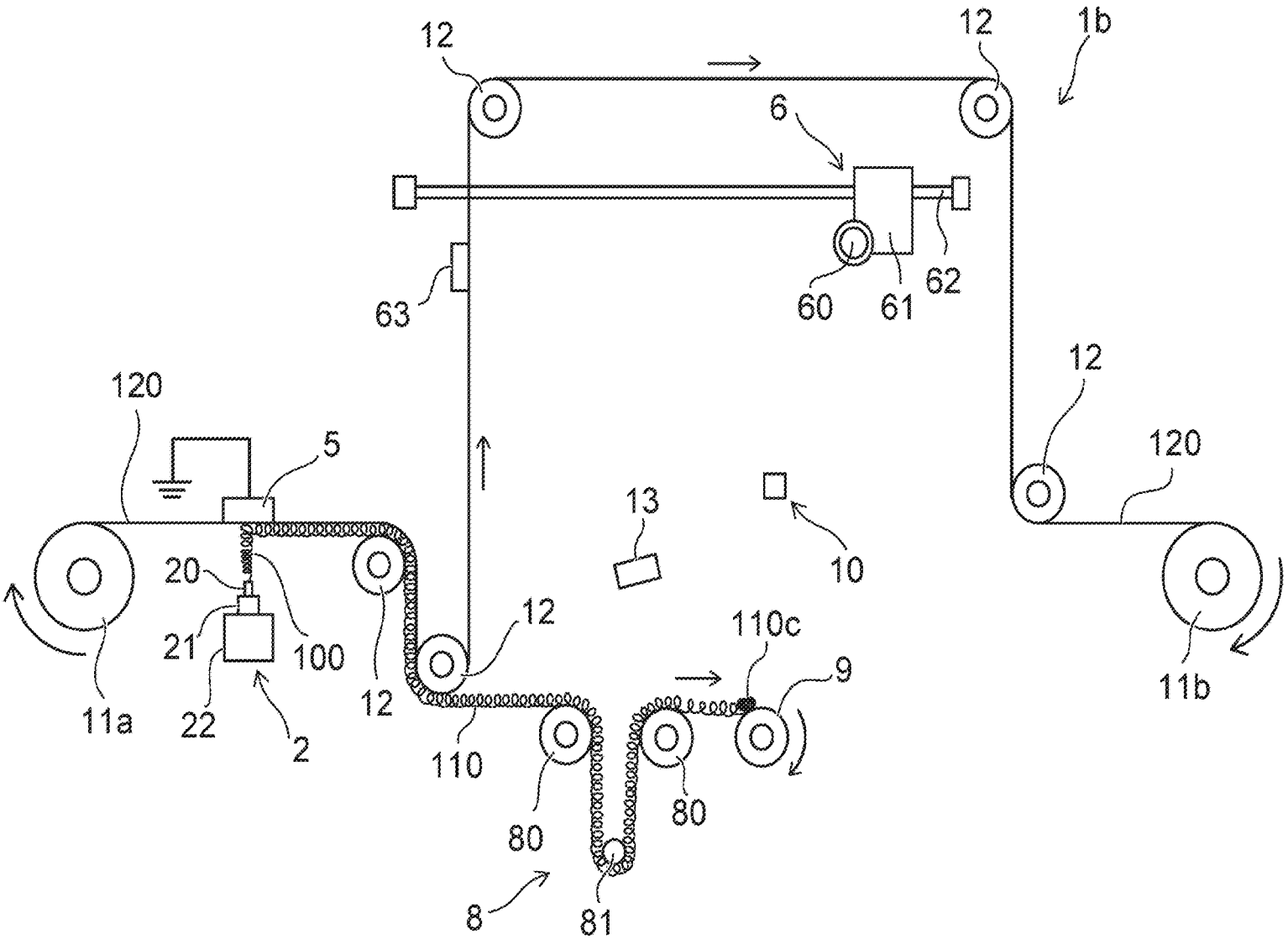

Then, as shown in FIG. 15, an operator fixes the mixture section 110*c* to the wind-up roller 9 via the tension section 8.

Subsequently, in substantially the same manner as in the electrospinning apparatus 1, the deposited body 110 is formed on the base member 120. Further, by rotating the roller 11*a* and the wind-up roller 11*b*, the deposited body 110 shaped like a strip is formed continuously. On this occasion, by applying the tension to the deposited body 110 shaped like a strip using the dancer roller 81, the deposited body 110 is exfoliated from the base member 120. Further, the deposited body 110 shaped like a strip is prevented from being loosened.

As described hereinabove, the method of manufacturing the deposited body 110 according to the embodiment can be provided with the following processes:

a process of forming the deposited body 100 by depositing the fiber 100 on the member using the electrospinning method; and a process of forming the mixture section 110*c*, in which the fiber 100 located on the member side of the deposited body 110 and the fiber 100 located on the opposite side to the member side of the deposited body 110 are mixed with each other, in the deposited body 110.

In this case, the fiber 100 located on the member side of the deposited body 110 can be arranged to have contact with the deposited body 110.

Further, in the process of forming the mixture section 110*c*, it is possible to arrange that the mixture section 110*c* is formed by scraping the deposited body 110 upward.

Alternatively, in the process of forming the mixture section 110*c*, it is possible to arrange that the mixture section 110*c* is formed by scraping aside the deposited body 110.

Further, it is possible to further providing a process of making the mixture section 110*c* get away from the member by holding the mixture section 110*c* and moving the mixture section 110*c* in a predetermined direction.

It should be noted that the content of each of the processes can be made substantially the same as described above, and therefore, the detailed description will be omitted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A method of manufacturing a deposited body, the method comprising:

forming the deposited body by depositing a fiber on a member using an electrospinning method; and forming a mixture section, in which a first fiber part of the deposited body, and a second fiber part of the deposited body are mixed with each other, in the deposited body, the first fiber part being located on the member, and the second fiber part being located on the first fiber part.

2. The method according to claim 1, wherein the first fiber part of the deposited body has contact with the member.

3. The method according to claim 1, wherein the first fiber part has a region having a first fiber density, and the second fiber part has a region having a second fiber density lower than the first fiber density.

4. The method according to claim 1, wherein the mixture section is formed in an end part of the deposited body.

5. The method according to claim 1, wherein in the forming the mixture section, the mixture section is formed by scraping the deposited body upward.

6. The method according to claim 1, wherein in the forming the mixture section, the mixture section is formed by scraping aside the deposited body in a predetermined direction.

7. The method according to claim 1, further comprising:

separating the mixture section from the member by moving the mixture section in a predetermined direction in a state of holding the mixture section.

* * * * *